US008397741B2

(12) United States Patent
Bisset

(10) Patent No.: US 8,397,741 B2
(45) Date of Patent: Mar. 19, 2013

(54) DELAY ACTIVATED VALVE AND METHOD

(75) Inventor: Stephen Bisset, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 817 days.

(21) Appl. No.: 12/482,186

(22) Filed: Jun. 10, 2009

(65) Prior Publication Data

US 2010/0314562 A1 Dec. 16, 2010

(51) Int. Cl.
*F16K 17/40* (2006.01)

(52) U.S. Cl. ..... 137/68.13; 137/68.16; 166/317

(58) Field of Classification Search ..... 137/68.13, 137/68.11, 68.16; 166/317, 63, 334.4, 373, 166/386, 319, 332.1, 334.1
See application file for complete search history.

(56) References Cited

U.S. PATENT DOCUMENTS

| | | | | | |
|---|---|---|---|---|---|
| 2,251,977 | A | * | 8/1941 | Burt | 166/156 |
| 3,111,133 | A | * | 11/1963 | Fulton et al. | 137/68.13 |
| 3,202,162 | A | * | 8/1965 | Eckardt et al. | 137/68.13 |
| 3,260,272 | A | * | 7/1966 | Eckardt | 137/68.13 |
| 3,329,208 | A | * | 7/1967 | Voetter | 166/63 |
| 3,358,961 | A | * | 12/1967 | Montgomery et al. | 251/11 |
| 3,430,568 | A | * | 3/1969 | Amster | 102/257 |
| 3,630,150 | A | * | 12/1971 | Rakowsky | 102/205 |
| 3,630,151 | A | * | 12/1971 | Rakowsky | 102/202 |
| 3,889,703 | A | * | 6/1975 | Keathley | 137/67 |
| 3,897,799 | A | * | 8/1975 | Lee | 137/68.13 |
| 3,994,232 | A | * | 11/1976 | Rakowsky et al. | 102/205 |
| 4,330,039 | A | * | 5/1982 | Vann et al. | 166/297 |
| 4,515,217 | A | * | 5/1985 | Stout | 166/297 |
| 4,535,842 | A | | 8/1985 | Ross | |
| 4,603,741 | A | * | 8/1986 | Edgmon | 166/369 |
| 4,614,156 | A | * | 9/1986 | Colle et al. | 102/312 |
| 5,101,727 | A | * | 4/1992 | Yarrington | 102/201 |
| 5,228,518 | A | * | 7/1993 | Wilson et al. | 166/369 |
| 5,252,796 | A | * | 10/1993 | Hedger | 200/82 R |
| 5,392,860 | A | | 2/1995 | Ross | |
| 5,753,849 | A | * | 5/1998 | Posey et al. | 102/223 |
| 6,102,126 | A | | 8/2000 | Huber et al. | |
| 6,131,594 | A | * | 10/2000 | Staggs et al. | 137/1 |
| 6,386,108 | B1 | * | 5/2002 | Brooks et al. | 102/217 |
| 6,540,029 | B2 | * | 4/2003 | Snoeys et al. | 169/46 |
| 6,814,005 | B1 | * | 11/2004 | Vestre | 102/202.5 |
| 2003/0141060 | A1 | | 7/2003 | Hailey et al. | |
| 2005/0247449 | A1 | * | 11/2005 | George et al. | 166/260 |

OTHER PUBLICATIONS

International Search Report; Date of Mailing Jan. 26, 2011; International Appln No. PCT/US2010/038169; 3 PAGES.

Bussear, Terry and Barrilleasu, Mark, "Design and Qualification of a Remotely-Operated, Downhole Flow Control System for High-Rate Water Injection in Deepwater", Society of Petroleum Engineers Inc. SPE 88563, Presentation at the SPE Pacific Oil and Gas conference and Exhibition, Perth, Australia, Oct. 18-20, 2004, pp. 1-8.

Jaua, J., Rivas, O., and Mejias, A., "Development of an Integrated Solution for Perforation, Production, and Reservoir Evaluation" SPE 102653, Society of Petroleum Engineers, Presentation at the First International Oil conference and Exhibition, Cancun, Mexico, Aug. 31-Sep. 2, 2006, pp. 1-10.

Saputelli, Lugigi, et al. "Integration of Computer-Aided High-Intensity Design with Reservoir Exploitation of Remote and Offshore Locations", SPE 64621 Society of Petroleum Engineers, Presentation at the SPE International Oil and Gas Conference and Exhibition, Beijing, China, Nov. 7-10, 2000, pp. 1-8.

* cited by examiner

*Primary Examiner* — Craig Schneider
*Assistant Examiner* — David Colon Morales
(74) *Attorney, Agent, or Firm* — Cantor Colburn LLP

(57) ABSTRACT

A flow control valve including, a tubular housing having a valve port, a piston disposed in the tubular housing having an orifice, the piston being slidable in the tubular housing to align the orifice with the valve port, a combustion portion at least partially defined by the tubular housing and the piston, and a propellant disposed in the combustion portion and method.

20 Claims, 3 Drawing Sheets

DELAY ACTIVATED VALVE AND METHOD

BACKGROUND

Flow control valves are well known in downhole industries and especially so in the hydrocarbon recovery industry. Commonly, valves including, but not limited to sliding sleeves are used in a downhole portion of a borehole to regulate the flow of fluids. Flow control valves include at least one port located on a tubular member that may be opened, choked and/or closed as desired. Although flow control valve configurations are many and are ubiquitous in their use within the art, the operation of some traditional flow control valve configurations is time consuming and expensive while the operation of others may not meet desired performance criteria. Reduction in costs while improving the function of flow control valves will be welcomed by the art.

SUMMARY

A flow control valve including, a tubular housing having a valve port, a piston disposed in the tubular housing having an orifice, the piston being slidable in the tubular housing to align the orifice with the valve port, a combustion portion partially defined by the tubular housing and the piston, and a propellant disposed in the combustion portion.

A flow control valve including, a port operative to transmit a fluid, a stopper portion operative to restrict the transmission of the fluid through the port, a combustion portion, a propellant disposed in the combustion portion, and a piston linked to the stopper portion and operative to be moved by a combustion of the propellant.

A method for operating a valve including triggering an actuator portion of the valve, and igniting a propellant with the actuator, the ignition of the propellant causing the movement of a piston linked to a stopper portion operative to restrict the flow of a fluid through the valve.

BRIEF DESCRIPTION OF THE DRAWINGS

Referring now to the drawings wherein like elements are numbered alike in the several figures.

DETAILED DESCRIPTION

Figure 1:
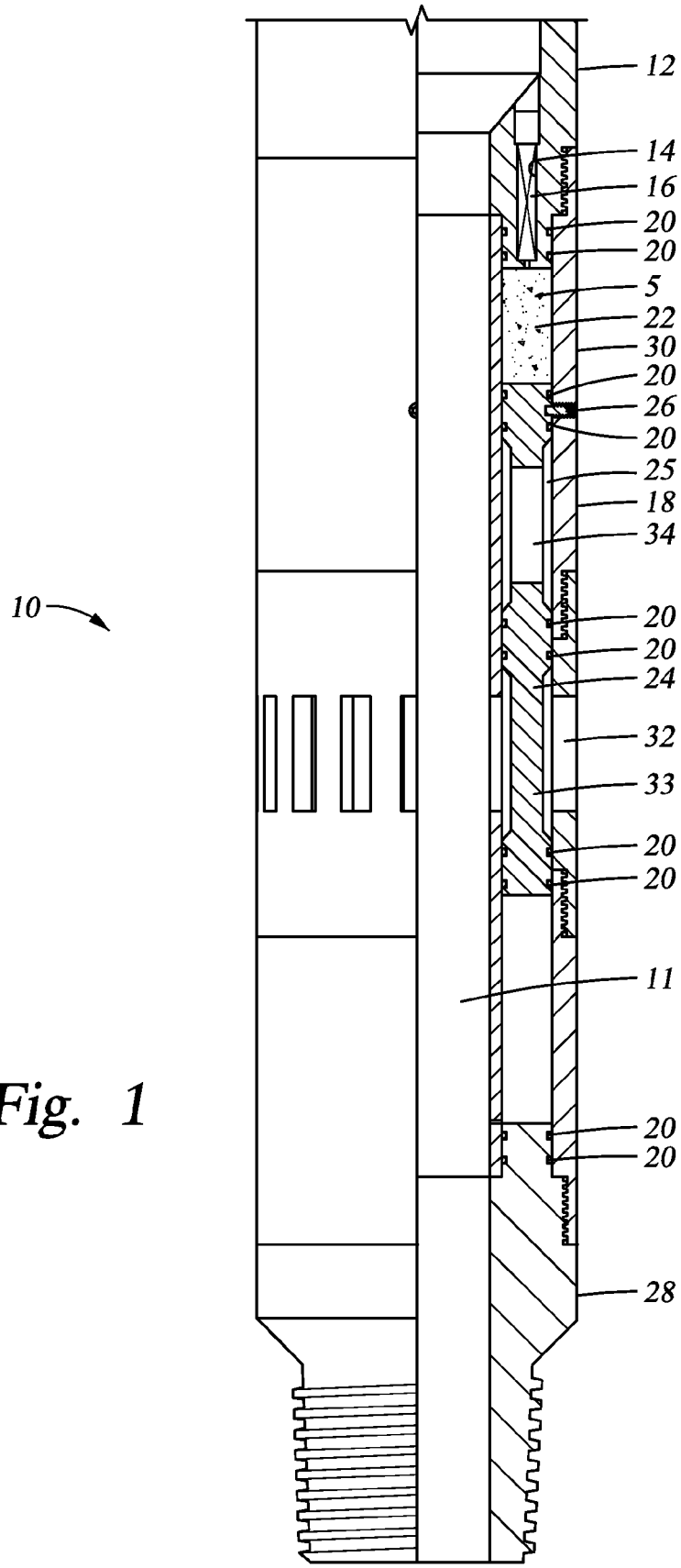
FIG. 1 is a partial cross sectional view of an embodiment of a delay activated valve in a closed position.

Referring to FIG. 1, an exemplary embodiment of a valve assembly 10 is illustrated. The valve assembly 10 has a longitudinal bore 11 and includes a top sub portion 12 having an inner cavity 14. An actuator 16 is disposed in the inner cavity 14. The actuator 16 may include for example, a slow-set power charge, a time delay mechanism, or other type of device capable of actuating the combustion of a combustible material. This system may use a BP-3S or BP-4S igniter that is activatable pursuant to a sufficient electrical charge being passed through it, or may be activated hydraulically using a RD Firing head adapter that is activatable by sufficient hydraulic pressure applied to a rupture disc in the assembly, or may be activated using a battery powered electronic timer and trigger which is activated using coded pressure pulses, etc. Each of these actuating concepts is known and commercially available from Baker Oil Tools, Houston Tex. The top sub portion 12 is sealably engageable with a piston housing 18. The illustrated embodiment includes O-rings 20 at the seal of the top sub portion 12 and the piston housing 18, however other embodiments may include other types of sealing arrangements to affect the seal of the top sub portion 12 and the piston housing 18. The interior of the piston housing 18 includes a combustion chamber portion 22. The communication piston 24 and combustion chamber portion 22 are provided outside of the longitudinal bore 11 and within an annulus 25 formed between the piston housing 18 and the longitudinal bore 11. A communication piston 24 is disposed in the piston housing 18, and partially defines the combustion chamber portion 22. The communication piston 24 includes a stopper portion 33 and orifice(s) 34 (illustrated in FIG. 2 described below). One or more release members 26 such as for example shear members, for example secure the communication piston 24 in the interior of the piston housing 18. An outer housing 30 includes ports 32. The piston housing 18 is sealably engageable with a bottom sub portion 28.

Figure 2:
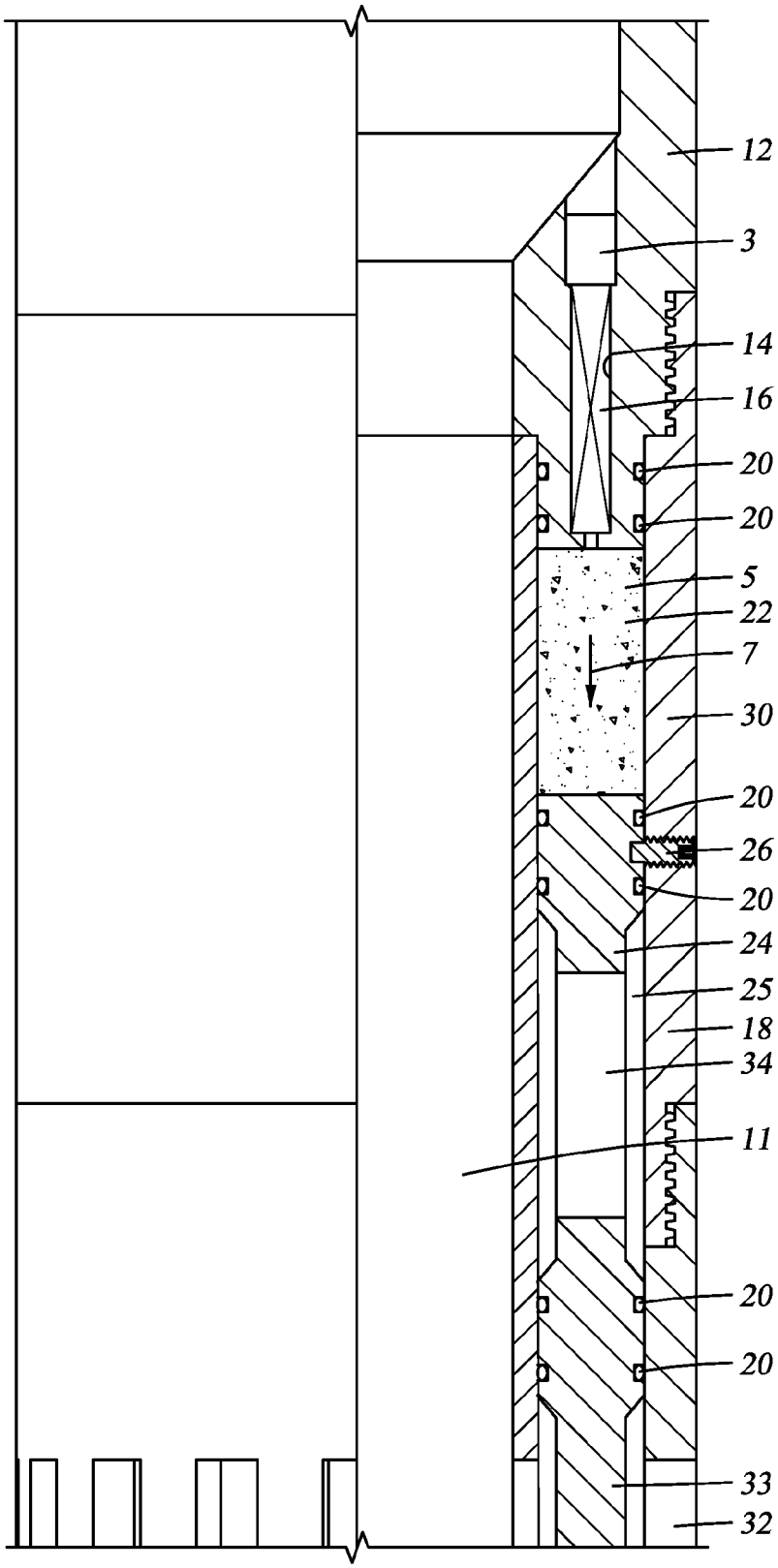
FIG. 2 is a close up view of the delay activated valve of FIG. 1.

FIG. 2 is a close up view of a portion of the valve assembly 10 that illustrates the operation of the valve assembly 10. In operation, an initiator portion 3 triggers the actuator 16. In the illustrated embodiment, the initiator portion 3 includes an assembly that receives hydraulic pressure that affects the trigger of the actuator 16. Other embodiments may include an initiator portion 3 that receives, for example, an electric, optical, electromagnetic signal, or pneumatic pressure to affect the trigger of the actuator 16. The actuator 16 is operative to ignite a combustible material 5 that is disposed in the combustion chamber 22. Examples of combustible material 5 include propellants such as black powder, a solid explosive, and a combustible liquid, gas, or gel. The deflagration of the combustible material 5 increases the pressure in the combustion chamber 22 and generates a force indicated by the arrow 7. The force is sufficient to release the release member(s) 26 (of FIG. 1). Once the member(s) 26 are released, the communication piston 24 moves along the longitudinal axis of the piston housing 18. The orifice(s) 34 aligns with the ports 32 (of FIG. 1) when the communication piston 24 travels to a stopping point in the piston housing 18. The alignment of the orifice 34 with the ports 32 opens the valve assembly 10 and allows the flow of fluid through the orifice 34 and ports 32.

Figure 3:
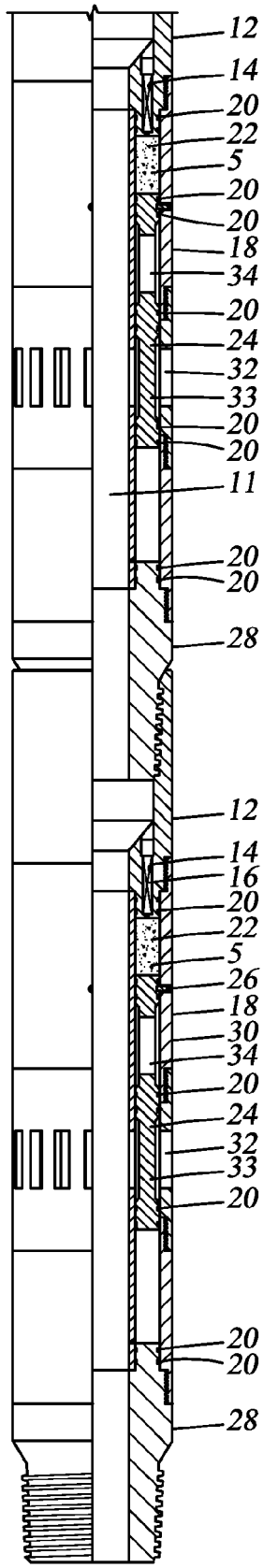
FIG. 3 is a partial cross sectional view of the delay activated valve shown in FIG. 1 with an embodiment of a second delay activated valve in a closed position.

In operation, a plurality of valve assemblies 10 may be used, such as shown in FIG. 3. It is desirable for the initiator portion 3 to trigger the actuator 16 of each of the plurality of valve assemblies prior to the combustion of the combustible material 5. The actuator 16 may include for example, a mechanical, electrical, or chemical time delay portion. Thus, the actuator 16 may delay the ignition of the combustible material 5 for a defined time period following the trigger of the actuator 16 by the initiator portion 3. The defined time period is sufficient for the initiator portion 3 to trigger the actuator 16 of each of the plurality of the valve assemblies 10 prior to the opening of the valve assemblies 10.

Though the illustrated embodiment shows a closed valve assembly 10 that is opened by the operation described above, alternate embodiments may include a valve assembly having the orifice 34 initially aligned with the ports 32 (an open valve assembly). A similar operation described above is used to move the communication piston 24 along the longitudinal axis of the piston housing such that the orifice 34 moves out of alignment with the ports 32, closing the valve.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A flow control valve comprising:

a tubular housing having a valve port and a longitudinal bore;

a piston disposed in the tubular housing having an orifice, the piston being slidable in the tubular housing to align the orifice with the valve port;

a combustion portion at least partially defined by the tubular housing and the piston; and a propellant disposed in the combustion portion;

wherein the piston and combustion portion do not obstruct the longitudinal bore.

2. The flow control valve as claimed in claim 1 further comprising an actuator operative to ignite the propellant.

3. The flow control valve as claimed in claim 2 wherein the actuator includes a time delay portion operative to delay the ignition of the propellant following a triggering of the actuator.

4. The flow control valve as claimed in claim 2 wherein the actuator includes a chemical explosive.

5. The flow control valve as claimed in claim 2 wherein the actuator is operative to be triggered by hydraulic pressure.

6. The flow control valve as claimed in claim 2 wherein the actuator is operative to be triggered by an electric signal.

7. The flow control valve as claimed in claim 2 wherein the actuator is operative to be triggered by pneumatic pressure.

8. A flow control valve comprising:

a tubular housing;

a port operative to transmit a fluid;

a stopper portion operative to restrict the transmission of the fluid through the port;

a combustion portion arranged in an annulus between the tubular housing and a longitudinal bore;

a propellant disposed in the combustion portion; and a tubular piston linked to the stopper portion, disposed in the annulus, and operative to be moved by a combustion of the propellant.

9. The flow control valve as claimed in claim 8 further comprising an actuator operative to ignite the propellant.

10. The flow control valve as claimed in claim 9 wherein the actuator includes a time delay portion operative to delay the ignition of the propellant following a triggering of the actuator.

11. The flow control valve as claimed in claim 9 wherein the actuator includes a chemical explosive.

12. The flow control valve as claimed in claim 9 wherein the actuator is operative to be triggered by hydraulic pressure.

13. The flow control valve as claimed in claim 9 wherein the actuator is operative to be triggered by an electric signal.

14. The flow control valve as claimed in claim 9 wherein the actuator is operative to be triggered by pneumatic pressure.

15. A method for operating a sliding sleeve type valve comprising:

triggering an actuator portion of the valve; and igniting a propellant, disposed in an annulus of the valve, with the actuator, the ignition of the propellant causing movement of a tubular piston linked to a stopper portion operative to restrict or allow the flow of a fluid through the valve.

16. The method as claimed in claim 15 wherein the triggering of the actuator portion starts a time delay.

17. The method as claimed in claim 16 wherein the time delay defines the elapsed time between the triggering of the actuator portion and the ignition of the propellant.

18. The method as claimed in claim 15 further comprising triggering the actuator portion with a hydraulic pressure.

19. The method as claimed in claim 18 further comprising triggering a second actuator portion of a second valve with the hydraulic pressure.

20. The method as claimed in claim 15 further comprising triggering the actuator portion with an electric signal.

* * * * *